US005582376A

United States Patent [19]

Thompson

[11] Patent Number: 5,582,376

[45] Date of Patent: Dec. 10, 1996

[54] STORE DISPLAY FIXTURE WITH MULTIPLE FUNCTION BRACKET

[75] Inventor: David G. Thompson, Toledo, Ohio

[73] Assignee: Valley Plastic Co., Inc., Perrysburg, Ohio

[21] Appl. No.: 389,213

[22] Filed: Feb. 15, 1995

[51] Int. Cl.[6] ..... A47B 96/06

[52] U.S. Cl. ..... 248/214; 248/225.11; 248/300; 248/911; 211/94

[58] Field of Search ..... 248/214, 200, 248/225.21, 225.11, 300, 911; 211/87, 94; 52/36.4, 36.5, 511, 483.1, 481.2

[56] References Cited

U.S. PATENT DOCUMENTS

| | | | |
|---|---|---|---|
| 1,580,706 | 4/1926 | Wright | 211/87 |
| 2,122,190 | 6/1938 | Wendt | 248/214 |
| 3,001,748 | 9/1961 | Austin | 248/300 X |
| 3,343,329 | 9/1967 | Pohutsky | 248/300 X |
| 4,062,511 | 12/1977 | Ray | 248/300 |
| 4,612,740 | 9/1986 | Yamamoto | 248/225.11 |
| 4,632,347 | 12/1986 | Jurgich | 248/213.2 |
| 4,720,116 | 1/1988 | Kay | 211/175 X |
| 4,852,838 | 8/1989 | Field | 211/87 X |
| 4,979,711 | 12/1990 | McIlroy | 248/214 |
| 5,199,579 | 4/1993 | Van Duyne | 211/175 X |
| 5,398,468 | 3/1995 | Erickson | 52/36.4 X |

*Primary Examiner*—Alvin C. Chin-Shue
*Assistant Examiner*—Brian J. Hamilla
*Attorney, Agent, or Firm*—MacMillan, Sobanski & Todd

[57] ABSTRACT

A multiple function bracket for attaching various display fixtures to slot walls, wire grid walls, hang bars and many other types of display fixtures. The bracket is formed with a top web and three depending flanges of unequal length and spacing. A narrow groove is formed between a high front flange and a medium height intermediate flange for engaging hang bars and smaller diameter wires on displays fixtures. A wider groove is formed between the intermediate flange and a shorter rear flange for engaging either a slot wall or larger diameter wires or rods in a wire grid wall. The rear flange is sufficiently short to pass into a slot in a slot wall. The bracket may be bonded or welded or otherwise secured to, for example, a display cabinet or a shelf or a neck arm. Or, a vertical hole may be formed in a vertical rib on a front face of the higher flange for receiving a wire hook or rod or other wire fixture.

16 Claims, 2 Drawing Sheets

STORE DISPLAY FIXTURE WITH MULTIPLE FUNCTION BRACKET

TECHNICAL FIELD

The invention relates to fixtures and displays of the type used, for example, in retail stores for displaying merchandise and more particularly to an improved multiple function store display bracket.

BACKGROUND ART

A large number of different types of fixtures are designed for displaying merchandise in stores. Stores often have pegboard walls, slot walls, and/or wire grid walls for supporting and displaying merchandise in addition to various floor fixtures on which merchandise may be placed or hung for display. Various types of brackets are designed for engaging different types of walls and display fixtures for holding the merchandise. Slot walls are provided with vertically spaced horizontal slots. In section, the slots have a "T" shape. Different types of displays are typically secured to the slots using brackets having an offset or "Z" shaped upper edge. The upper edge of the bracket fits into the slot and the bracket is held in place by the edge engaging the slot. Such a bracket is not capable of engaging a wire grid wall or a horizontal hang bar. One type of wire grid wall consists of a grid wires welded together into a grid forming 3 inch squares. The wires typically are up to gauge O, or 0.3065 inch diameter. However, other wire sizes and grid spacings also are used. A common hang bar is a steel bar of about 0.12 inch thick by about 0.5 inch high. The hang bar is horizontally mounted on a wall or on a floor or counter display fixture. Displays which are supported on wire grid walls and hang bars typically include one or more inverted "U" shaped brackets. The brackets generally have a gap sized to closely engage the wire or hang bar. Two different size brackets are used for typical hang bars and wire grid walls. If the bracket is too loose on the wire or on the bar, the display can move and may lack stability. The brackets used for wire grid walls and hang bars have not been suitable for use on slot walls.

One type of retail store display fixture has pairs of spaced horizontal wires. The display fixture may sit on a counter for holding jewelry, for example. The wires may be 11 gauge or smaller, or up to 0.120 inch diameter and may have a spacing in each pair of about 0.5 inch. A greater spacing is provided between the pairs of wires. Jewelry or other small merchandise may be hung on the wires. Or, many brackets designed for engaging a hang bar also may be supported on a wire pair.

In the past, a bracket designed for engaging one type of wall system or display fixture generally was not suitable for use with other types of wall systems, display fixture or hang bars. If a store has displays including, for example, slot walls and either wire grid walls or hang bars, separate sets of brackets were required for use with each. Ira single bracket could be designed for use with multiple types of fixture and wall constructions, the required inventory of brackets would be reduced and the display cost for a store would be reduced.

DISCLOSURE OF INVENTION

The invention is directed to a multiple function bracket for use with various types of store displays. The bracket is capable of use with slot walls, wire grid walls, hang bars and fixtures having spaced pairs of small diameter wire. The bracket generally consists of an extrusion or a molding having an inverted "E" shaped section with a top web and three spaced parallel flanges. The two side flanges are of unequal heights and the intermediate flange is of an intermediate height. The intermediate flange is spaced closer to the higher side flange than to the shorter side flange. The spacing between the intermediate flange and the shorter side flange forms a groove capable of hooking over and engaging either the lower edge of a slot in a slot wall or a relatively large diameter wire on a wire grid wall. The spacing between the intermediate flange and the higher side flange forms a narrow groove capable of hooking over and engaging either a 0.120 inch or thinner hang bar or pairs of wires of no greater than 0.120 inch and having a spacing of about 0.5 inch.

The bracket may be used for various display purposes. It may be attached to the back of various types of displays, such as cabinets and shelves for displaying various merchandise, for hanging on a slot wall or on a wire grid wall or on a hang bar. Or, a neck arm may be attached to the bracket for supporting clothes hangers from a slot wall or a wire grid wall. In still another embodiment, a raised vertical rib projects from the outer front face of the highest flange. An end of a wire is received in a vertical hole in the rib. The wire may form a hook for hanging merchandise on a wall. Hooks may be formed with shafts of various lengths and shapes for hanging various types of merchandise. In addition to engaging a wall, the hook and bracket may be used with hang bars and wire fixtures for displaying merchandise. Or, a wire ladder or grid may be formed with two wire ends bent for engaging two brackets. For example, a wire fixture known in the trade as an ear ring ladder may be mounted using two of the brackets for displaying ear rings.

Accordingly, it is an object of the invention to provide a multiple function bracket for use with store displays.

Other objects and advantages of the invention will become apparent from the following detailed description of the invention and the accompanying drawings.

BEST MODE FOR CARYING OUT THE INVENTION

Figure 1:
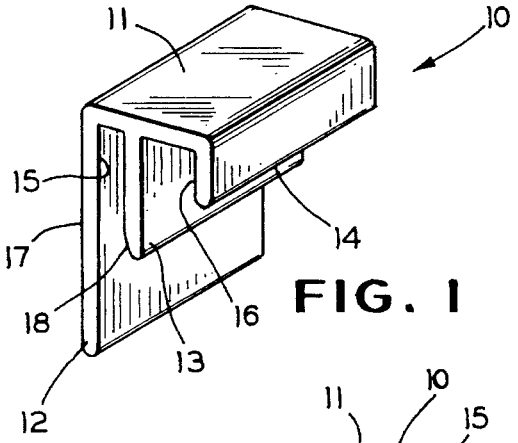
FIG. 1 is a perspective view of a store display bracket according to one preferred embodiment of the invention.

Referring first to FIG. 1 of the drawings, a bracket 10 is illustrated according to one embodiment of the invention.

The bracket 10 is of a generally inverted "E" shape and has a top web 11 and three connected flanges 12, 13 and 14. The bracket 10 is preferably formed as an extruded channel and may be formed, for example, from aluminum or from a strong plastic material such as acrylic DR. Depending upon its use, the extrusion is cut into a desired length to form the bracket 10.

The three flanges 12–14 are of different heights. One side flange 12 is the highest, the other side flange 14 is the shortest and the intermediate flange 13 is of an intermediate height. The flanges 12 and 13 are spaced to define a narrow first groove 15 and the flanges 13 and 14 are spaced to define a wider second groove 16. Preferably, the first groove 15 has a width of about 0.125 inch and the second groove 16 has a width of about 0.312 inch for use with slot walls and various displays commonly used in the United States. The flanges are preferably sized with the flange 12 having a height of about 1 inch, the flange 13 having a height of about 0.5 inch and the flange 14 having a height of about 0.25 inch. In any event, the height of the shortest side flange 14 plus the thickness of the web 11 should be less than 0.375 inch to permit entry of the flange 14 into slots in a standard slot wall. When the bracket 10 is used in other countries having other standard dimensions for slot walls, wire grid walls and hang bars, the dimensions will be modified accordingly. The intermediate flange 13 may be provided with a slight taper 18 at the side of its free end facing the slot 15 to facilitate inserting the bracket 10 onto hang bars and wires which are positioned in the groove 15. The flange 12 has an outer surface 17 which can be secured to conventional displays, such as a display cabinet or a display shelf, etc. The bracket 10 may be secured to a display by a suitable adhesive or with fasteners such as rivets or screws (not shown).

Figure 2:
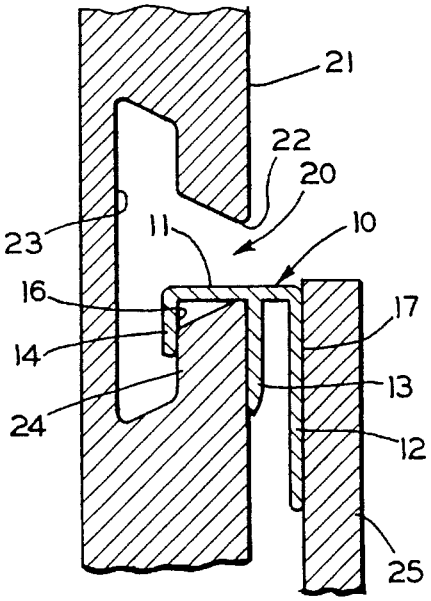
FIG. 2 is an fragmentary cross sectional side elevational view showing the bracket of FIG. 1 engaging a slot wall.

FIG. 2 is a fragmentary cross sectional view showing the bracket 10 engaging a slot 20 in a slot wall 21. The slot 20 is of a generally "T" shape and includes a throat 22 opening into a wider chamber 23. The slot has a lower lip 24 which defines one side of the throat 22. The shortest flange 14 on the bracket 10 has a height smaller than the width of the throat opening 22 to allow passage of the flange 14 through the throat 22. Typically, the throat 22 has a width of about 0.375 inch. The intermediate flange 13 has a height greater than the width of the throat opening 22 and consequently cannot enter the throat 22. The width of the bracket groove 16 is sufficiently greater than the thickness of the lip 24 to permit the lip 24 to enter the groove 16. For example, if the groove 16 has a width of 0.312 inch, the slot wall lip 24 may be between about 0.25 and 0.30 inch thick. The groove 16 should be sufficiently wide to engage slot walls 21 from different manufacturers and with some manufacturing tolerance variations. Some clearance between the sides of the bracket groove 16 and the lip 24 is acceptable. The bracket 10 is attached to the slot wall 21 by passing the shortest flange 14 through the slot throat opening 20 and moving the bracket 10 in a downward direction until the web 11 abuts the lip 24. A fragmentary portion of a store display fixture 25 is shown secured to the bracket surface 17 by a suitable adhesive (not shown).

Figure 3:
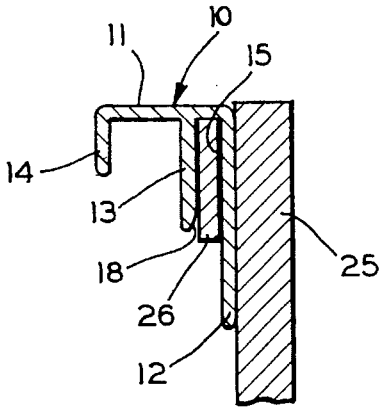
FIG. 3 is an side elevational view showing the bracket of FIG. 1 engaging a bar.

FIG. 3 is a cross sectional view showing the bracket 10 positioned on a hang bar 26. The hang bar 26 is positioned in the narrower groove 15, which preferably is sized to closely engage the hang bar 26. The taper 18 facilitates inserting the bracket 10 over the hang bar 26.

Figure 4:
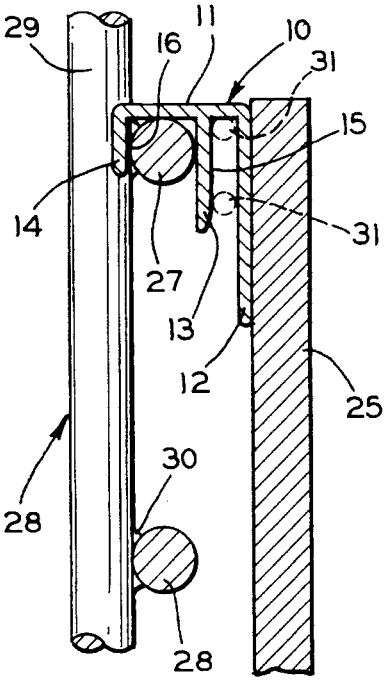
Fig. 4 is a fragmentary cross sectional side elevational view showing the bracket engaging a wire grid.

FIG. 4 is a cross sectional view showing the bracket 10 engaging a horizontal wire 27 of a wire grid wall 28. The wire grid wall consists of uniformly spaced horizontal wires 27 secured to spaced vertical wires 29 by welds 30. The bracket 10 is positioned on the grid wall 28 with the wire 27 positioned in the wider groove 16 against the web 11. In place of the grid wall 28 having relatively large diameter wires, the bracket 10 also may be used with wire fixtures having pairs of closely spaced smaller diameter wires. FIG. 4 also illustrates the bracket 10 engaging two smaller diameter wires 31, which are shown in dashed lines. One or both of the smaller diameter wires are located in the narrower groove 15. It will be appreciated that the weight of the bracket 10 and any attached display fixture 25 will be carried by the upper one of the wires 31. Thus, FIGS. 2–4 illustrate the multiple function capability of the bracket 10 for engaging a conventional slot wall 21, a hang bar 26, a wire grid wall 28 and pairs of spaced wires 31 on a fixture.

Figure 5:
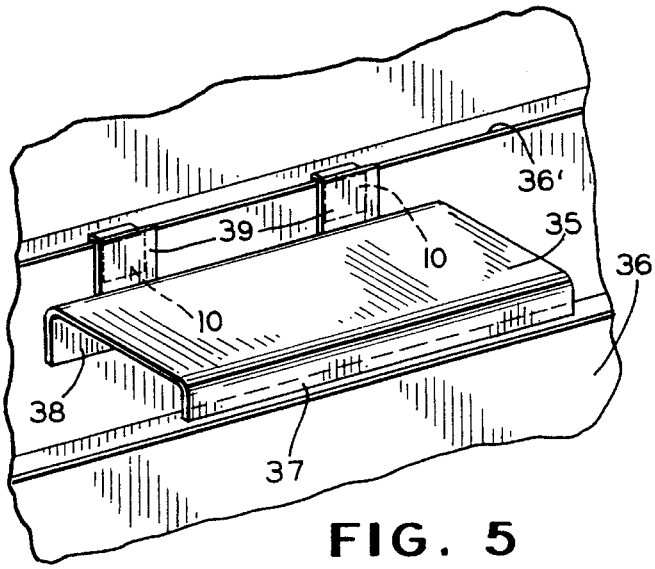
Fig. 5 is a fragmentary perspective view showing a shoe display shelf mounted on a slot wall using two of the brackets of FIG. 1.

FIG. 5 illustrates an application of the brackets 10 for hanging a shoe display shelf 35 on a slot wall 36. The shelf 35 is formed by bending a sheet of acrylic. Front and back edges 37 and 38, respectively, are bent downwardly to give the shelf strength. Two horizontally spaced tabs 39 are formed either by cutting and bending up a portion of the back edge 38 or by bonding separate acrylic pieces to the back edge 38. A bracket 10 is secured to each tab 39. The shelf 35 is attached to the slot wall 36 by engaging a slot 36' with the brackets 10. The shelf 35 may be sized to hold a shoe, or it may be sized to hold other types of merchandise.

Figure 6:
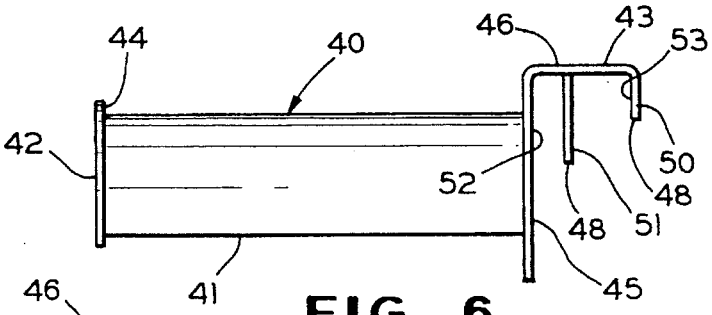
FIG. 6 is a side elevational view of a neck arm with an integral bracket according to modified embodiment of the invention.
Figure 7:
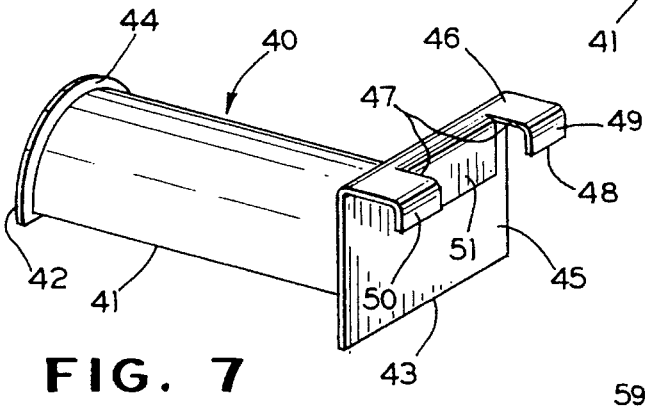
FIG. 7 is a perspective view of the neck arm of FIG. 6.

FIGS. 6 and 7 illustrate a neck arm 40 which is suitable for supporting clothing on hangers. The neck arm 40 includes a body 41, a front end plate 42 and a bracket 43, which preferably are all formed from metal for strength. The body 41 is formed from a sheet of metal bent to form an arc in section. The body 41 may be sized to receive the hooks on clothes hangers (not shown). The end plate 42 is welded to the body and has a lip 44 which is of a slightly larger dimension than the body 41 for retaining the hangers on the body 41. The bracket 43 has a front flange 45 which is welded to the body 41. The metal forming the flange 45 is bent to form an upper web 46. Two spaced cuts 47 are formed in the web 46 to extend to an edge 48. The cuts 47 form three tabs: two relatively narrow outer tabs 49 and 50 and a wider center tab 51. The center tab 51 is bent downwardly near the flange 45 to define a relatively narrow first groove 52 between the flange 45 and the center tab 51. The two outer tabs 49 and 50 are bent downwardly further from the flange 45 to define a wider second groove 53 between the plane of the tabs 49 and 50 and the plane of the tab 51. Since the tab 51 is bent further from the edge 48 than the tabs 49 and 50, the tab 51 will be longer than the tabs 49 and 50. In operation, the tabs 49 and 50 of the bracket 40 function the same as the short flange 14 of the bracket 10 and the tab 51 functions the same as the intermediate flange 13 on the bracket 10. Preferably, the narrower groove 52 will have a width of about 0.125 inch and the wider groove 53 will have a width of about 0.312 inch when the neck arm 40 is used in the United States.

Figure 8:
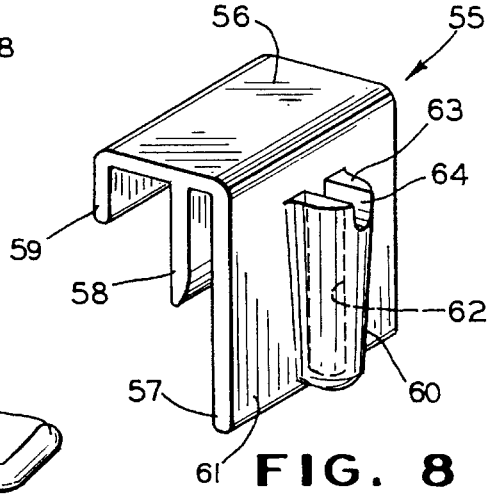
FIG. 8 is a perspective view of a store display bracket according to a modified embodiment of the invention.

FIG. 8 illustrates a modified bracket 55 which is adapted for supporting wire hooks, rods, wire shelves, wire ladders and similar devices. The bracket 55 is quite similar to the bracket 10 and includes a web 56 and three depending flanges 57, 58 and 59. The flanges 57–59 of the bracket 55 may be identical in construction and spacing to the flanges 12–14 of the bracket 10. A raised vertical rib 60 is formed on a front face 61 of the flange 57. A vertical hole 62 is formed to extend from an upper end 63 of the rib 60 at least part way through the length of the rib 60. Preferably, a notch 64 is formed in the rib 60 adjacent the upper end 63. The notch 64 has the same width as the diameter of the hole 62 and connects with the hole 62. The bracket 55 may be molded from a strong plastic material, such as acrylic DR, or it may be formed from a metal such as aluminum.

Figure 9:
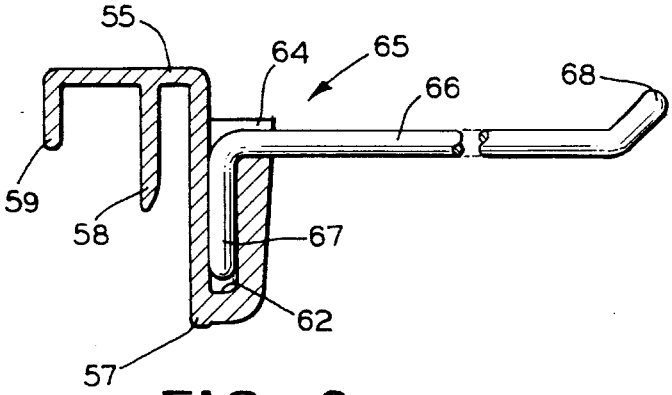
Fig. 9 is a side cross sectional view showing a wire hook positioned in the bracket of FIG. 8.

FIG. 9 illustrates a wire rod hanger 65 which includes a bracket 55. The hanger 65 includes a horizontal wire or rod 66 having an end 67 which is bent downwardly and a free end 68 which is bent slightly upwardly. The downwardly bent end 67 extends downwardly into the vertical bracket hole 62. The wire 66 extends through the notch 64 to prevent the wire 66 from rotating relatively to the bracket 55. When the bracket 55 is attached, for example, to a slot wall, the wire 66 extends horizontally for hanging merchandise. Alternately, the wire 66 may be shaped into a hook or any other desired configuration.

Figure 10:
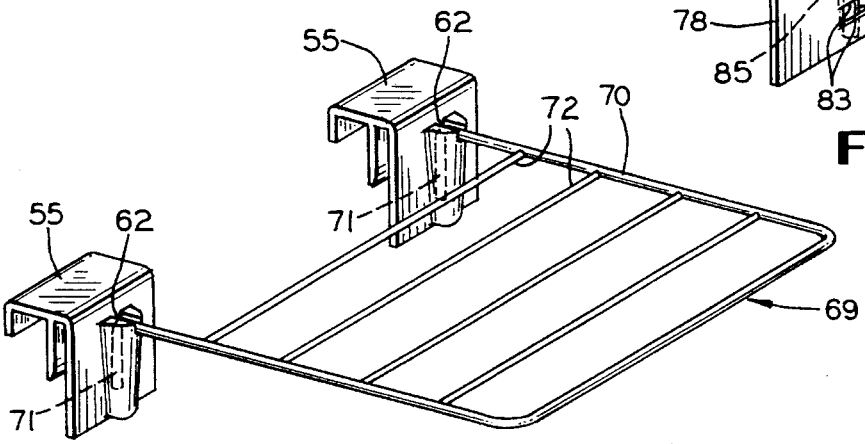
FIG. 10 is a perspective view showing a wire ear ring ladder attached to two of the brackets of FIG. 8.

FIG. 10 illustrates a wire ear ring ladder 69 which is mounted using two of the brackets 55. A wire frame 70 is bent into a three sided rectangle. Free ends 71 of the wire frame 70 are bent downwardly and inserted into the holes 62 in the two brackets 55. When the brackets 55 are attached to a wall or hang bar or fixture, the wire frame 70 may extend horizontally, or it may angle downwardly. A plurality of wire cross members 72 are attached to the frame 70 for hanging pairs of ear rings or other merchandise.

Figure 11:
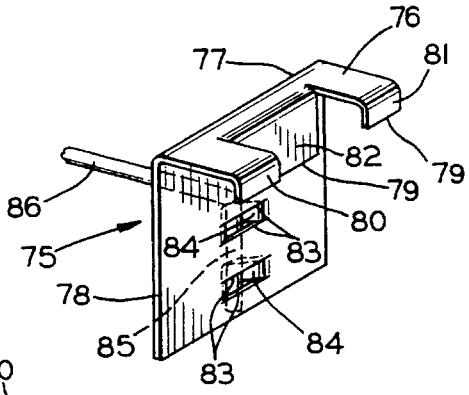
FIG. 11 is a perspective view of a store display bracket according to a further modified embodiment of the invention.

FIG. 11 illustrates a bracket 75 according to a further embodiment of the invention. The bracket 75 is similar to the bracket 43 of FIG. 7 in that is formed from bent sheet material. The bracket 75 may be formed of either steel, aluminum or a strong plastic. The bracket 75 includes a top web 76 bent at a front edge 77 to define an integral downwardly directed front flange 78. A rear edge 79 is cut or otherwise shaped to define two outer tabs 80 and 81 and a center tab 82. The center tab 82 is bent downwardly a predetermined first distance from the flange 78 to define a first groove and the outer tabs 80 and 81 are bent downwardly a predetermined second distance greater than the first distance from the flange 78 to define a second groove. As previously described, the second groove is larger than the first groove and the tabs 80 and 81 are shorter than the tab 82. Two pairs of parallel horizontal cuts 83 are formed in the flange 78 in vertical alignment. Two vertically aligned loops 84 are formed by stretching the strips between the adjacent cuts in each pair 83. The loops 84 extend to the front of the flange 78 and are adapted to receive a downwardly directed end 85 of a wire 86. If desired, the wire end 86 may be welded or otherwise secured to the flange 78 to retain the wire end in the loops 84 and to prevent rotation of the wire end 85 relative to the flange 78. Or, tabs (not shown) may be stamped in the flange 78 and bent to engage sides of the wire 86 to prevent rotation of the wire 86 in the bracket 75. Thus, the bracket 75 is stamped and bent from a sheet material and can function in a manner identical to the bracket 55 of FIG. 8.

It will be appreciated that various modifications and changes may be made to the above described preferred embodiments of a store display bracket without departing from the spirit and the scope of the following claims. For example, it will be appreciated that the multiple function bracket may be adopted for mounting various known types of store displays fixtures and devices to walls, fixtures and the like. The bracket may be used with special fittings adapted to hold and display specific merchandise, such as eye glasses, jewelry, clothing, etc.

I claim:

1. In combination, a store display fixture and a multiple function bracket adapted for selectively mounting said display fixture from different support members having at least two different thicknesses, said bracket comprising a horizontal top web, and first, second and third parallel vertical flanges depending from said web, said first and second flanges defining a downwardly opening first groove open at its bottom and closed by said web at its top and adapted to releasably engage display fixture support members of up to a first predetermined thickness, said second and third flanges defining a downwardly opening second groove open at its bottom and closed by said web at its top and adapted to releasably engage display fixture support members of up to a second predetermined thickness greater than said first predetermined thickness, and means securing said display fixture to said first flange.

2. The combined store display fixture and a multiple function bracket, as set forth in claim 1, and wherein said second flange is shorter than said first flange and said third flange is shorter than said second flange.

3. The combined store display fixture and a multiple function bracket, as set forth in claim 2, and wherein said first groove has a with of about 0.125 inch and said second groove has a width of about 0.312 inch.

4. The combined store display fixture and a multiple function bracket, as set forth in claim 2, and wherein said bracket is an extrusion formed from a materiel selected from the group consisting of acrylic DR and aluminum.

5. The combined store display fixture and a multiple function bracket, as set forth in claim 2, wherein said display fixture includes a wire and wherein said securing means includes a vertical hole formed in said first flange, said hole having an open top receiving said display fixture wire.

6. The combined store display fixture and a multiple function bracket, as set forth in claim 5, and wherein said first flange has a front face including a vertical rib, and wherein said vertical hole is formed in said rib.

7. The combined store display fixture and a multiple function bracket, as set forth in claim 6, and wherein said bracket is a molding formed from a material selected from the group consisting of acrylic DR and aluminum.

8. The combined store display fixture and a multiple function bracket, as set forth in claim 1, wherein said display fixture includes a wire, and a vertical hole formed in said first flange, said hole having an open top receiving said display fixture wire.

9. The combined store display fixture and a multiple function bracket, as set forth in claim 8, and wherein said first flange has a front face including a vertical rib, and wherein said vertical hole is formed in said rib.

10. The combined store display fixture and a multiple function bracket, as set forth in claim 9, and wherein said bracket is a molding formed from a material selected from the group consisting of acrylic DR and aluminum.

11. In combination, a store display fixture and a multiple function bracket adapted for selectively mounting the display fixture from different support members having at least two different thicknesses, said bracket comprising a sheet of material having a rear edge and a shape defining a horizontal top web, a vertical flange bent downwardly from a front edge of said top web, said rear edge forming first, second and third vertical tabs extending from said top web with said first and third tabs located on opposite sides of said second tab, wherein said second tab is bent downwardly from said web a predetermined first distance from said flange to define with said flange a downwardly opening first groove open at its bottom and closed by said web at its top, and wherein said first and third tabs are each bent downwardly a predetermined second distance greater than said first distance from said flange to define with said second tab a downwardly opening second groove open at its bottom and closed by said web at its top, wherein said second groove is wider than said first groove, wherein said first groove is adapted to releasably engage support members of a thickness no greater than the width of said first groove and said second groove is adapted to releasably engage support members of a thickness no greater than the width of said second groove, and means securing said display fixture to said flange.

12. The combined store display fixture and a multiple function bracket, as set forth in claim 11, and wherein said second tab is longer than said first tab.

13. The combined store display fixture and a multiple function bracket, as set forth in claim 11, and wherein said first groove has a width of about 0.125 inch and said second groove has a width of about 0.312 inch.

14. The combined store display fixture and a multiple function bracket, as set forth in claim 12, and wherein said display fixture includes a wire having a vertical end, wherein said securing means includes first and second spaced pairs of vertically aligned horizontal cuts in said flange, said first pair of cuts defining a first strip and said second pair of cuts defining a second strip, and wherein said first and second strips are formed to define first and second vertically aligned loops extending from a front face of said flange and receiving said vertical wire end.

15. The combined store display fixture and a multiple function bracket, as set forth in claim 12, wherein said fixture includes a neck arm, and wherein said securing means is a weld securing said neck arm to a front face of said flange.

16. The combined store display fixture and a multiple function bracket, as set forth in claim 11, wherein said fixture includes a neck arm, and wherein said securing means is a weld securing said neck arm to a front face of said flange.

* * * * *

UNITED STATES PATENT AND TRADEMARK OFFICE

CERTIFICATE OF CORRECTION

PATENT NO. : 5,582,376

DATED : December 10, 1996

INVENTOR(S) : David G. Thompson

It is certified that error appears in the above-indentified patent and that said Letters Patent is hereby corrected as shown below:

Column 1, Line 55, after "each.", change "Ira" to -- If a --.

Signed and Sealed this

Twenty-sixth Day of August, 1997

*Attest:*

Bruce Lehman

BRUCE LEHMAN

*Attesting Officer*

*Commissioner of Patents and Trademarks*